US009311878B2

(12) United States Patent
Cheng

(10) Patent No.: US 9,311,878 B2
(45) Date of Patent: Apr. 12, 2016

(54) DISPLAY PANEL AND SCANNING CIRCUIT

(71) Applicant: AU Optronics Corporation, Hsin-Chu (TW)

(72) Inventor: Shih-Song Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 173 days.

(21) Appl. No.: 14/056,421

(22) Filed: Oct. 17, 2013

(65) Prior Publication Data

US 2014/0333601 A1 Nov. 13, 2014

(30) Foreign Application Priority Data

May 9, 2013 (TW) ..... 102116563 A

(51) Int. Cl.
*G09G 5/00* (2006.01)
*G09G 3/36* (2006.01)

(52) U.S. Cl.
CPC ..... *G09G 3/3659* (2013.01); *G09G 3/3677* (2013.01); *G09G 2310/0267* (2013.01); *G09G 2310/0286* (2013.01); *G09G 2310/06* (2013.01); *G09G 2320/0214* (2013.01)

(58) Field of Classification Search
CPC ..... G09G 2310/0286; G09G 3/3677; G09G 2310/0267; G09G 3/3659; G09G 2310/0289; G09G 2310/06; G09G 2320/0214
See application file for complete search history.

(56) References Cited

U.S. PATENT DOCUMENTS

| | | | | |
|---|---|---|---|---|
| 7,027,551 | B2 | 4/2006 | Han et al. | |
| 2010/0141641 | A1* | 6/2010 | Furuta | G11C 19/184 345/213 |
| 2010/0171728 | A1* | 7/2010 | Han | G09G 3/3677 345/211 |
| 2010/0260312 | A1* | 10/2010 | Tsai | G09G 3/3677 377/79 |
| 2011/0091006 | A1* | 4/2011 | Liu | G09G 3/3677 377/68 |

FOREIGN PATENT DOCUMENTS

| | | |
|---|---|---|
| CN | 102760409 | 10/2012 |
| CN | 103137207 | 6/2013 |

* cited by examiner

*Primary Examiner* — Lixi C Simpson
(74) *Attorney, Agent, or Firm* — WPAT, PC; Justin King

(57) ABSTRACT

A display panel and a scanning circuit are disclosed herein. The scanning circuit includes a plurality of shift registers. Each of the shift registers includes a driving unit, a control unit, and an operating unit. The driving unit is configured to receive a start signal and a driving clock signal, and provide a scan signal to an output end according to the start signal and the driving clock signal. The control unit is configured to provide a second voltage to the output end according to a first voltage on a control node, and to provide the second voltage to a driving end according to the first voltage on the control node. The operating unit is configured to operatively provide the first voltage to the control node according to an operating clock signal after the scan signal is outputted.

19 Claims, 18 Drawing Sheets

DISPLAY PANEL AND SCANNING CIRCUIT

RELATED APPLICATIONS

This application claims priority to Taiwan Application Serial Number 102116563, filed May 9, 2013, which is herein incorporated by reference.

BACKGROUND

1. Technical Field

The present disclosure relates to an electronic device and an electronic circuit therein. More particularly, the present invention relates to a display panel and a scan circuit therein.

2. Description of Related Art

With advances in electronic technology, display panels are widely used in our daily lives, such as being applied to mobile phones and computers.

The display device typically includes a scan circuit, a data circuit and a plurality of pixels arranged in an array. The scan circuit can include a plurality of stages of shift registers electrically connected in series to each other. Through the shift registers, the scan circuit can generate a plurality of scan signals, and provides the scan signals to scan lines in the pixel array, so as to turn on the pixels row-by-row/column-by-column. The data circuit can generate a plurality of data signals simultaneously, and provide the data signals to the pixels which are turned on, such that the display statuses (e.g., colors and grey levels) of the pixels which are turned on can be updated accordingly. Through such an operation, images can be displayed and updated on the display panel.

In practice, each of the shift registers in the scan circuit can include a plurality of switches. The switches can be implemented by metal oxide semiconductor field-effect transistors (MOSFETs) or thin film transistors (TFTs). The scan circuit can generate the scan signals by turning on/off the switches at specific time points. However, the leakage currents of the switches may cause voltage shifts of some specific nodes in the shift registers, and such voltage shifts may make the scan circuit output the scan signals incorrectly and result in operational instability of the display panel.

SUMMARY

One aspect of the present invention is directed to a scan circuit. In accordance with one embodiment of the present invention, the scan circuit includes a plurality of shift registers electrically connected in series to each other. Each of the shift registers includes a driving unit, a control unit, and an operating unit. The driving unit is configured to receive a start signal and a driving clock signal, and provide a scan signal to an output end according to the start signal and the driving clock signal. The control unit is electrically connected to the driving unit through a driving node, in which the control unit is configured to provide a second voltage to the output end according to a first voltage on a control node, and to provide the second voltage to the driving node according to the first voltage on the control node. The operating unit is electrically connected to the control unit through the control node, in which the operating unit is configured to operatively provide the first voltage to the control node according to an operating clock signal in each cycle period of the operating clock signal after the scan signal is outputted.

Another aspect of the present invention is directed to a display panel. In accordance with one embodiment of the present invention, the display panel includes a scan circuit, in which the scan circuit includes a plurality of shift registers, and the shift registers are electrically connected in series to each other. Each of the shift registers includes a first driving switch, a second driving switch, a first capacitor, a first control switch, a second control switch, a second capacitor, a first operating switch, a second operating switch, a third operating switch, a fourth operating switch, and a third capacitor. The first driving switch is electrically connected between a driving node and a first voltage and configured to operatively be turned on according to a start signal. The second driving switch is electrically connected to an output end, in which the second driving switch is configured to receive a driving clock signal and to operatively be turned on according to the first voltage on the driving node. The first capacitor is electrically connected between the driving node and the output end. The first control switch is electrically connected between the driving node and a second voltage and configured to operatively be turned on according to the first voltage on a control node. The second control switch is electrically connected between the output end and the second voltage and configured to operatively be turned on according to the first voltage on the control node. The second capacitor is electrically connected between the control node and the first voltage. The first operating switch and the second operating switch are electrically connected to each other in series and are electrically connected between the control node and the first voltage. The third operating switch is electrically connected between the second voltage and the operating node and configured to operatively be turned on according to the start signal. The fourth operating switch is electrically connected between the second voltage and the control node and configured to operatively be turned on according to the start signal. The third capacitor is electrically connected to the operating node and configured to receive an operating clock signal. The first operating switch and the second operating switch are configured to operatively be turned on according to the operating clock signal, so as to provide the first voltage to the control node in at least every two line times.

Thus, through application of one of the embodiments mentioned above, the first voltage can be provided to the control node in at least every two line times, such that the voltage level of the control node can be maintained at a stable level. With such a configuration, voltage shift of the control node can be avoided, and incorrect output of the scan signals by the shift register can also be prevented.

BRIEF DESCRIPTION OF THE DRAWINGS

The invention can be more fully understood by reading the following detailed description of the embodiments, with reference made to the accompanying drawings as follows.

DETAILED DESCRIPTION

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawings.

With respect to "electrically connect" or "connect" used herein, both of these terms can refer to physical contact or electrical contact performed directly or indirectly between two or more elements. "Electrically connect" or "connect" can further refer to the interoperation or interaction between two or more elements.

Figure 1:
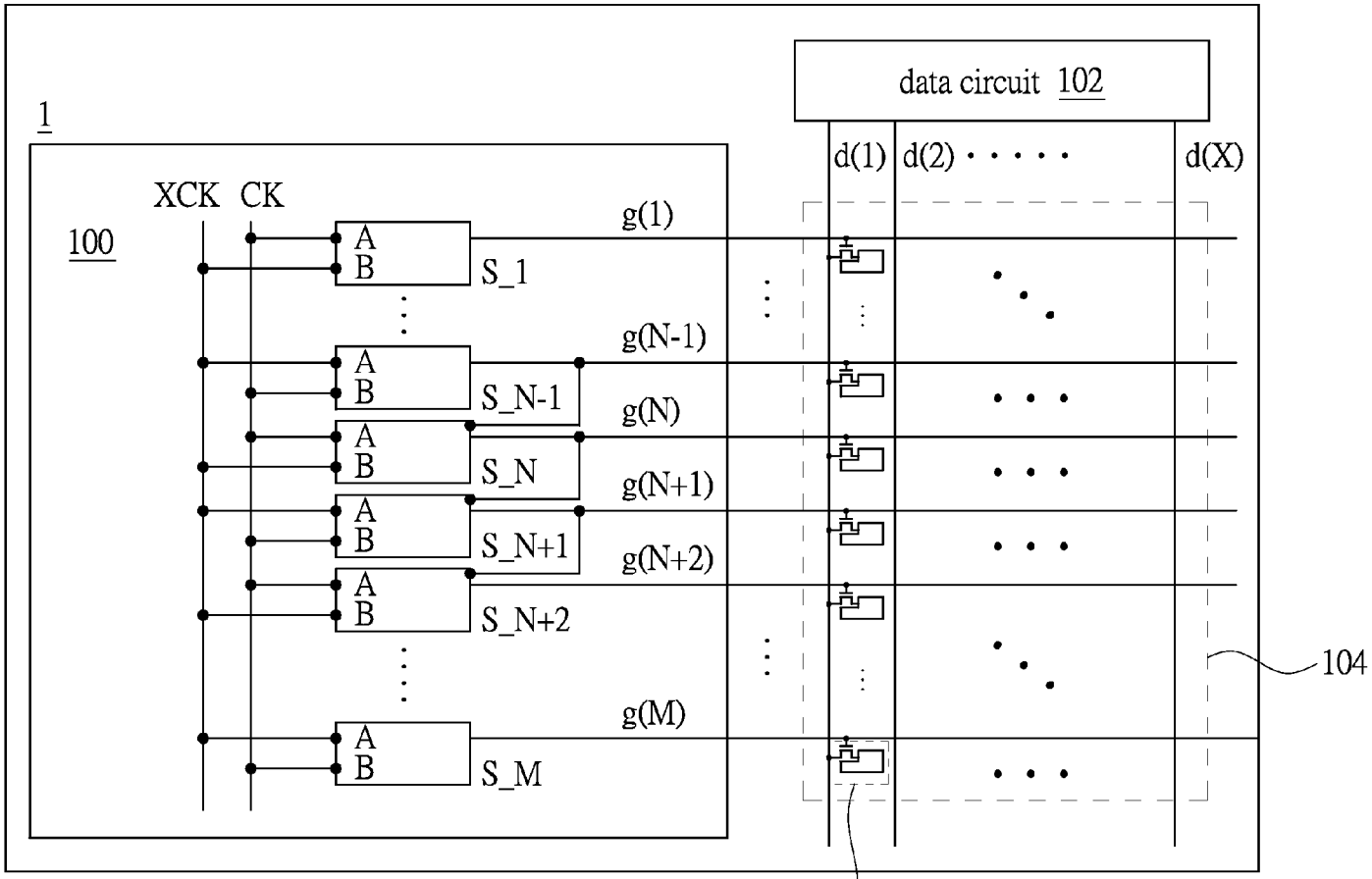
FIG. 1 is a schematic diagram of a display panel in accordance with one embodiment of the present disclosure.

FIG. 1 is a schematic diagram of a display panel 1 in accordance with one embodiment of the present disclosure. The display panel 1 can include a scan circuit 100, a data circuit 102, and a pixel array 104. The pixel array 104 can include a plurality of pixels 106 arranged in an array. The scan circuit 100 can sequentially generate a plurality of scan signals g(1), . . . , g(M) and provide scan signals g(1), . . . , g(M) to the pixels 106 in the pixel array 104, so as to turn on the pixels 106 row-by-row/column-by-column. M is an arbitrary integer. The data circuit 102 can generate a plurality of data signals d(1), . . . , d(X) simultaneously, and provide the data signals d(1), . . . , d(X) to the pixels 106 which are turned on, such that the display statuses (e.g., colors and grey levels) of the pixels 106 which are turned on can be updated accordingly. X is an arbitrary integer. With such an operation, images can be displayed and updated on the display panel 1.

In this embodiment, the scan circuit 100 can include a plurality of stages of shift registers S_1, . . . , S_M electrically connected in series to each other. For example, the shift register S_1 is electrically connected to the shift register S_2, and the shift register S_2 is electrically connected to the shift register S_3. The shift registers S_1, . . . , S_M are respectively configured to generate the scan signals g(1), . . . , g(M) according to a start signal and clock signals CK, XCK. For example, in this embodiment a shift register S_N can receive a scan signal g(N−1) from a previous shift register S_N−1 as a start signal, and generate a scan signal g(N) according to the scan signal g(N−1) and the clock signals CK, XCK.

In this embodiment, the scan circuit 100, for example, can provide the clock signal CK to the odd shift registers S_1, S_3, . . . , S_M−1 (where M is an even integer) to serve as clock signals A of the odd shift registers S_1, S_3, . . . , S_M−1 and provide the clock signal XCK to the odd shift registers S_1, S_3, . . . , S_M−1 to serve as clock signals B of odd shift registers S_1, S_3, . . . S_M−1. In addition, the scan circuit 100 can provide the clock signal XCK to the even shift registers S_2, S_4, . . . , S_M to serve as clock signals A of the even shift registers S_2, S_4, . . . , S_M and provide the clock signal CK to the even shift registers S_2, S_4, . . . , S_M to serve as clock signals B of the even shift registers S_2, S_4, . . . , S_M.

The odd shift registers S_1, S_3, . . . , S_M−1, for example, can be represented as {S_a}, in which "a" is an odd integer. The even shift registers S_2, S_4, . . . , S_M, for example, can be represented as {S_b}, in which "b" is an even integer. In FIG. 1, the shift register S_N, for example, is one of the odd shift registers {S_a}, and the register S_M, for example, is one of the even shift registers {S_b}.

In this embodiment, the cycle periods of clock signals CK, XCK are identical, and the phases of clock signals CK, XCK are opposite. Similarly, the cycle periods of clock signals A, B of each of the shift registers S_1, . . . , S_M are identical, and the phases of clock signals A, B of each of the shift registers S_1, . . . , S_M are opposite.

It should be noted that, in other embodiments, the scan circuit 100 can provide the clock signal XCK to the odd shift registers S_1, S_3, . . . , S_M−1 (where M is an even integer) to serve as the clock signals A of the odd shift registers S_1, S_3, . . . , S_M−1 and provide the clock signal CK to the odd shift registers S_1, S_3, . . . , S_M−1 to serve as the clock signals B of odd shift registers S_1, S_3, . . . S_M−1. In addition, the scan circuit 100 can provide the clock signal CK to the even shift registers S_2, S_4, . . . , S_M to serve as the clock signals A of even shift registers S_2, S_4, . . . , S_M and provide the clock signal XCK to the even shift registers S_2, S_4, . . . , S_M to serve as the clock signals B of the even shift registers S_2, S_4, . . . , S_M.

To better explain the present invention, a shift register S_N will be taken as an example to describe details of the shift registers S_1, . . . , S_M of the scan circuit 100.

Figure 2:
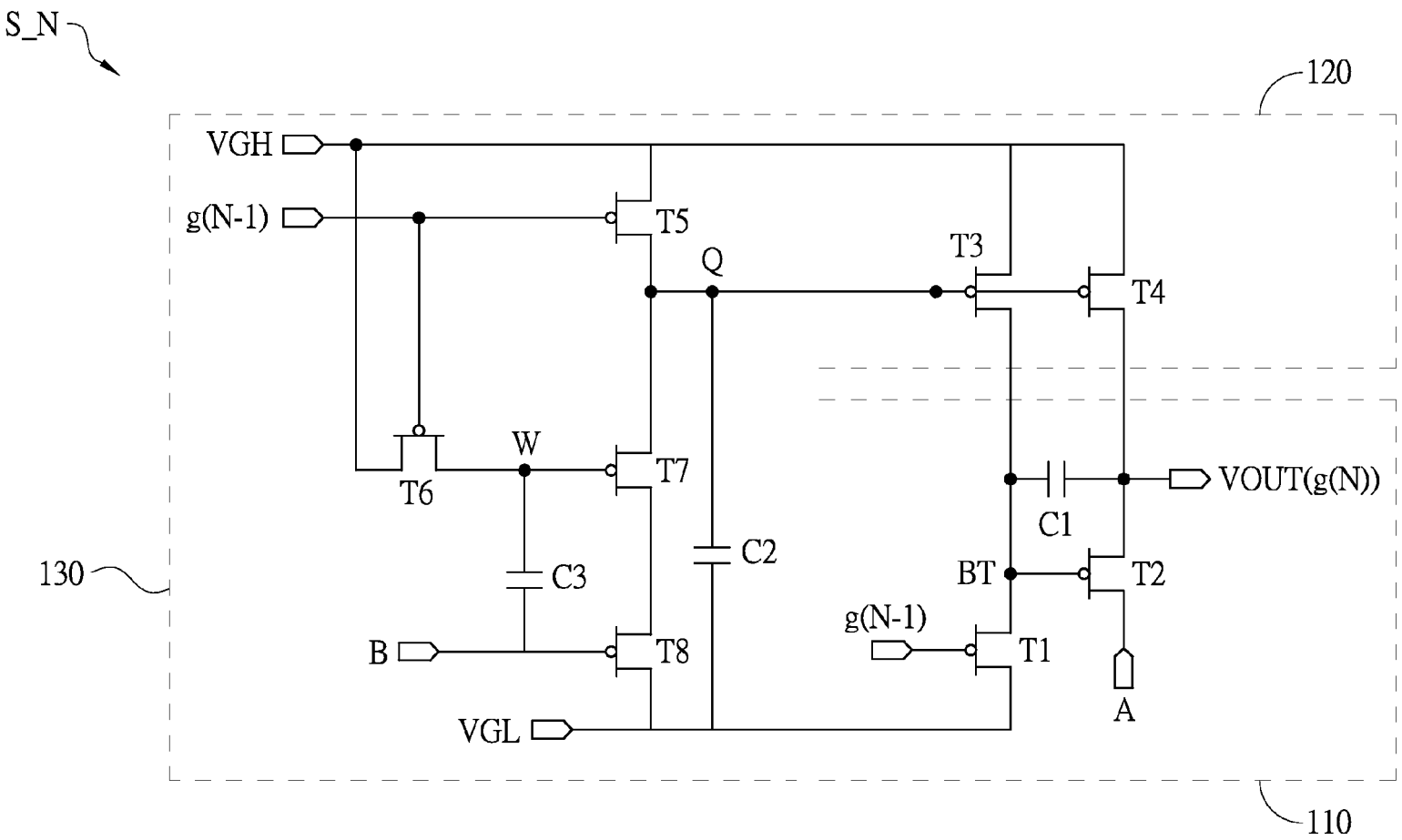
FIG. 2 is a schematic diagram of a shift register in accordance with one embodiment of the present disclosure.

FIG. 2 is a schematic diagram of the shift register S_N in accordance with one embodiment of the present disclosure. In this embodiment, the shift register S_N includes a driving unit 110, a control unit 120, and an operating unit 130. The control unit 120 can be electrically connected to the driving unit 110 through a node BT and an output end VOUT. The operating unit 130 can be electrically connected to the control unit 120 through a node Q.

The driving unit 110 is configured to receive a start signal (e.g., the scan signal g(N−1) generated by the previous shift register S_N−1) and the clock signal A, and provide the clock signal A to the output end VOUT according to the scan signal g(N−1) to serve as the scan signal g(N) outputted by the shift register S_N.

The control unit 120 is configured to provide a voltage VGH (e.g., with a high voltage level) to the output end VOUT according to a voltage VGL (e.g., with a low voltage level) on the node Q in a condition that the node Q has the voltage VGL to make the output end VOUT stop outputting the scan signal g(N). In addition, the control unit 120 is also configured to provide the voltage VGH to a node BT in a condition that the node Q has the voltage VGL to make the driving unit 110 stop providing the clock signal A to the output end VOUT.

The operating unit 130 is configured to provide the voltage VGL to the node Q (e.g., to pull down the voltage level on the node Q) in each cycle period of the clock signal B according to the clock signal B after the scan signal g(N) is outputted from the output end VOUT. In another words, the operating unit 130 can operatively provide the voltage VGL to the node Q in at least every two line times, such that the voltage level on the node Q can be maintained at the voltage level of the voltage VGL. The term "line time" used herein refers to the time period of one of the scan signals outputted by the shift registers S_1-S_M. It should be noted that, in this embodiment, the operation in which the voltage VGL is provided to node Q is taken as a descriptive example. However in other embodiments, other voltages can be provided to node Q on the basis of actual requirements, and the invention is not limited to the voltage VGL described in the embodiment above.

The shift register S_N can be realized with such a configuration. In addition, the voltage level on the node Q can be maintained at a stable level by providing the voltage VGL to the node Q in each period of the clock signal B. Thus, voltage shift of the node Q can be avoided, and incorrect output of the scan signal g(N) by the shift register S_N can also be prevented.

In the following paragraphs, details of the driving unit 110, the control unit 120, and the operating unit 130 will be provided. However, the invention is not limited to the details described below.

In one embodiment, the driving unit 110 can include switches T1, T2, and a capacitor C1. The switch T1 can be electrically connected between the node BT and the voltage VGL, and is configured to receive the start signal (i.e., scan signal g(N−1)), and to be turned on according to the start signal, so as to conduct the voltage VGL to the node BT. One end of the switch T2 can be electrically connected to the output end VOUT, and another end of the switch T2 is configured to receive the clock signal A. The switch T2 can be configured to be turned on according to the voltage VGL on the node BT or a voltage VGL_BT on the node BT in a case that the node BT has the voltage VGL or the voltage VGL_BT, so as to conduct the clock signal A to the output end VOUT. The capacitor C1 can be electrically connected between the node BT and the output end VOUT. In one embodiment, the capacitor C1 can be a parasitic capacitor of the switch T2.

The control unit 120 can include switches T3, T4. The switch T3 can be electrically connected between the node BT and the voltage VGH, and configured to be turned on according to the voltage VGL on the node Q in a case that the node Q has the voltage VGL, so as to conduct the voltage VGH to the node BT. The switch T4 can be electrically connected between the output end VOUT and the voltage VGH, and configured to be turned on according to the voltage VGL on the node Q in a case that the node Q has the voltage VGL, so as to conduct the voltage VGH to the output end VOUT.

The operating unit 130 can include switches T5, T6, T7, T8 and capacitors C2, C3. The switch T5 can be electrically connected between the voltage VGH and the node Q, and configured to receive the start signal (i.e., the scan signal g(N−1)) and to be turned on according to the start signal, so as to conduct the voltage VGH to the node Q. The switch T6 can be electrically connected between the voltage VGH and a node W, and configured to receive the start signal and to be turned on according to the start signal, so as to conduct the voltage VGH to the node W. A first end of the switch T7 can be electrically connected to the node Q, a second end of the switch T7 can be electrically connected to a first end of the switch T8, and a second end of the switch T8 can be electrically connected to the voltage VGL. That is, the switches T7, T8 can be electrically connected to each other in series and be electrically connected between the node Q and the voltage VGL. The capacitor C2 can be electrically connected between the node Q and the voltage VGL. One end of the capacitor C3 can be electrically connected to the node W, and another end the capacitor C3 can be configured to receive the clock signal B. The capacitor C3 can be configured to make the voltage on the node W change in a manner corresponding to the clock signal B.

It should be noted that, in this embodiment, all the switches T1-T8 can be p-type transistors. In addition, all the switches T1-T8 can be implemented by metal oxide semiconductor field-effect transistors (MOSFETs) or thin film transistors (TFTs).

In the following paragraphs, to facilitate the description of the operations of the shift register S_N to follow, reference will now be made to FIGS. 3*a*, 3*b*, 4*a*, 4*b*, 5*a*, 5*b*, 6*a*, 6*b*, 7*a*, 7*b*.

Figure 3A:
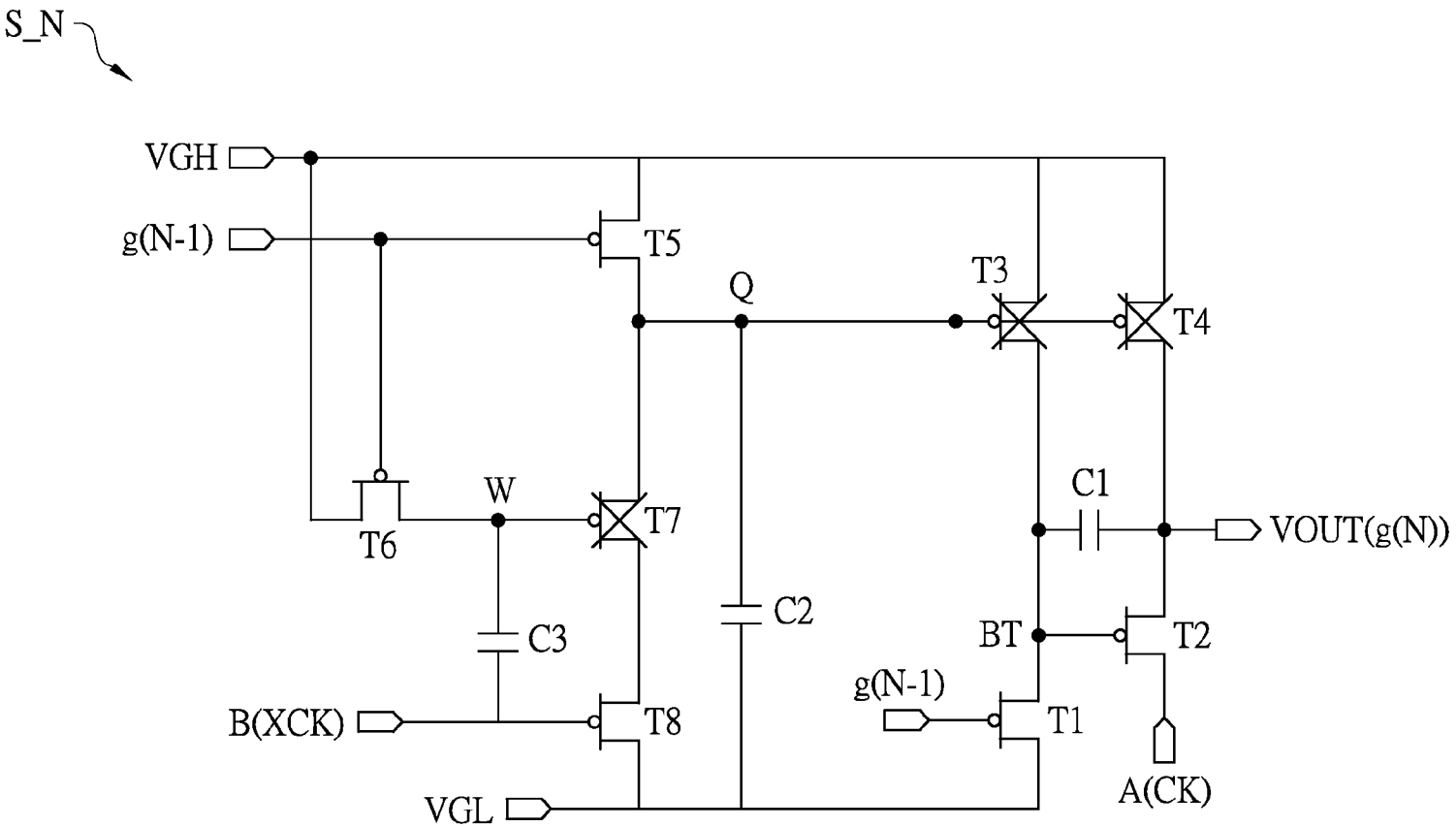
FIG. 3*a* is a diagram illustrating a state of the shift register in FIG. 2.
Figure 3B:
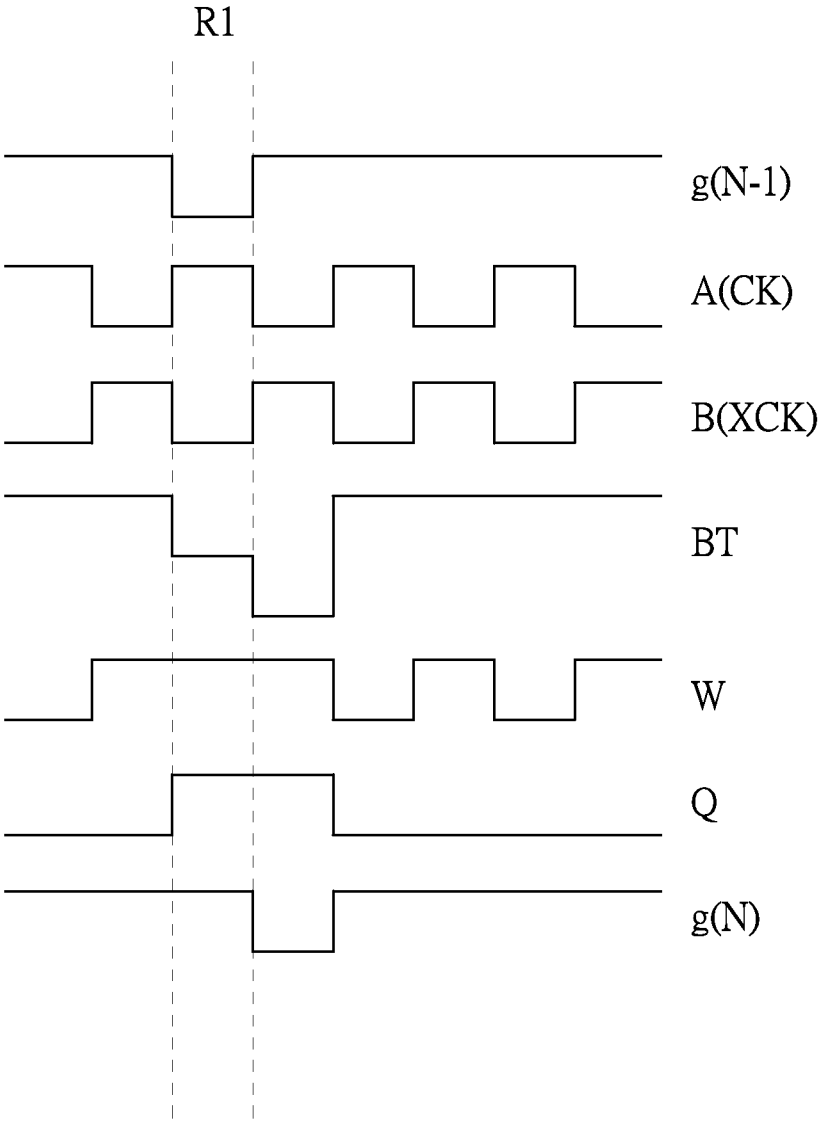
FIG. 3*b* is a time chart of signals of the shift register in FIG. 3*a;*

FIG. 3*a* is a diagram illustrating a state of the shift register S_N in FIG. 2. FIG. 3*b* is a time chart of signals of the shift register S_N in FIG. 3*a*. In the duration R1, the switch T1 is turned on according to the scan signal g(N−1) (e.g., has a low voltage level) to conduct and provide the voltage VGL to the node BT. The switch T2 is turned on according to the voltage VGL on the node BT to conduct and provide the clock signal A having a high voltage level to the output end VOUT. In addition, the switch T5 is turned on according to the scan signal g(N−1) to conduct and provide the voltage VGH to the node Q, so as to prevent the switch T4 from providing the voltage VGH to the output end VOUT. The switches T3, T4 are turned off according to the voltage VGH on the node Q. Moreover, the switch T6 is turned on according to the scan signal g(N−1) to conduct and provide the voltage VGH to the node W. The switch T8 is turned on according to the clock signal B with a low voltage level. The switch T7 is turned off according to the voltage VGH on the node W to prevent the voltage VGL from being provided to the node Q and causing the shift register S_N to operate improperly.

Figure 4A:
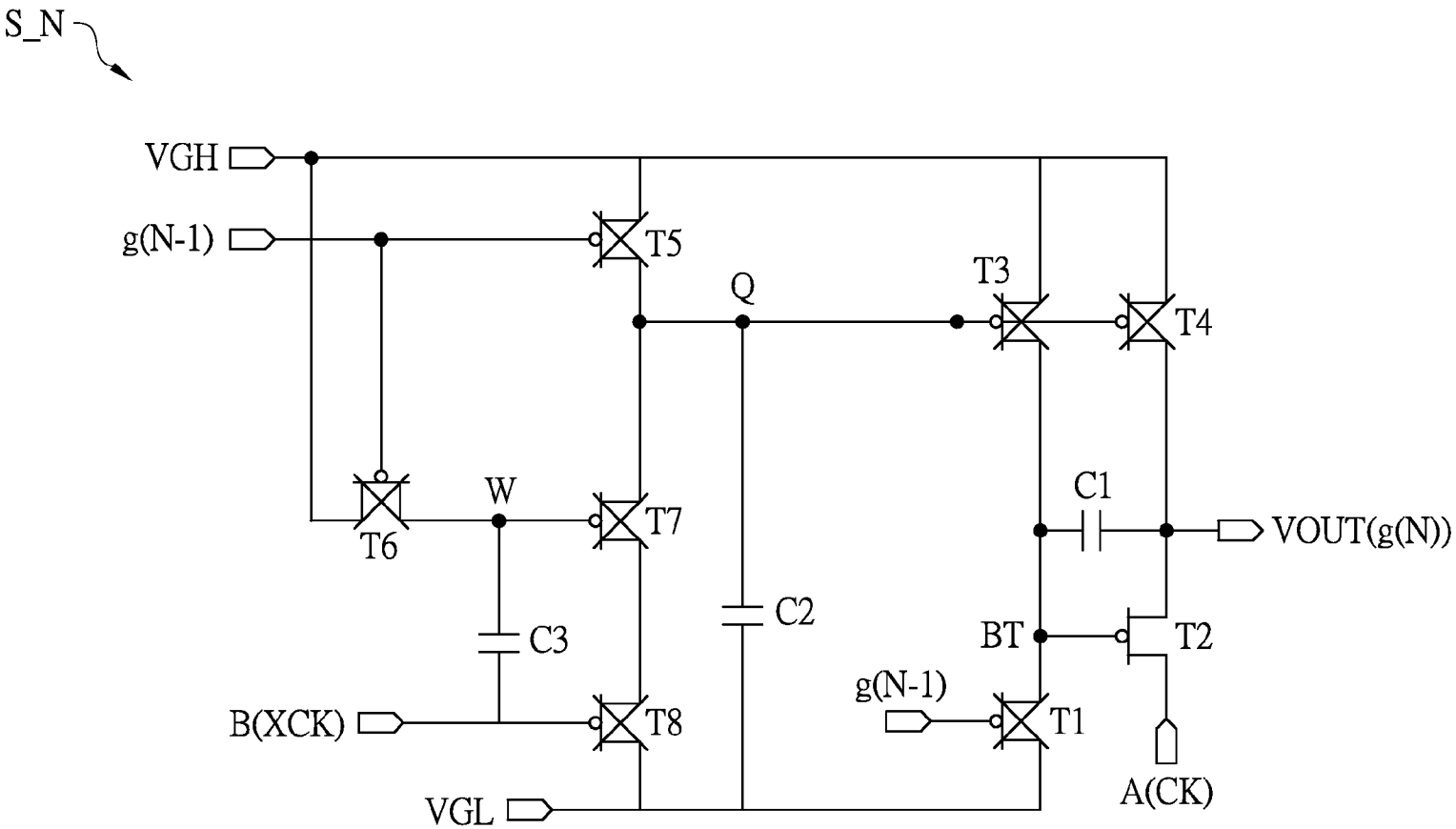
FIG. 4*a* is a diagram illustrating another state of the shift register in FIG. 2.
Figure 4B:
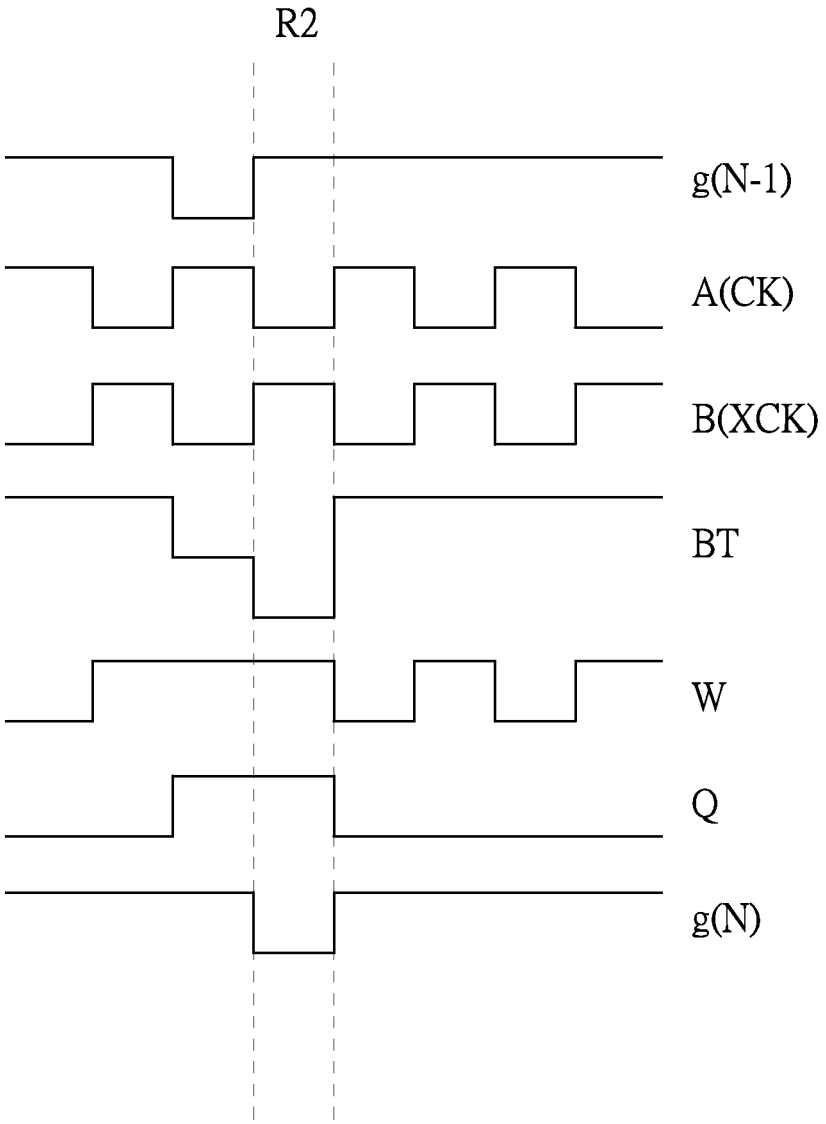
FIG. 4*b* is a time chart of signals of the shift register in FIG. 4*a;*

Subsequently, reference will now be made to FIGS. 4*a* and 4*b*. FIG. 4*a* is a diagram illustrating another state of the shift register S_N in FIG. 2. FIG. 4*b* is a time chart of signals of the shift register S_N in FIG. 4*a*. In the duration R2, the switch T1 is turned off since the switch T1 does not receive the scan signal g(N−1) (e.g., the scan signal g(N−1) has a high voltage level). The capacitor C1 makes the voltage level on the node BT change (e.g., pulls down) to a voltage VGL_BT according to the clock signal A having a low voltage level. The switch T2 is turned on according to the voltage VGL_BT on the node BT to provide the clock signal A having the low voltage level to the output end VOUT to serve as the scan signal g(N). It should be noted that by pulling down the voltage level on the node BT to the voltage VGL_BT, the switch T2 can be turned on according to the voltage VGL_BT which is lower than the clock A having the low voltage level, such that the clock A can be successfully provided to the output end VOUT to serve as the scan signal g(N).

In addition, in the duration R2, the switch T5 is turned off since the switch T5 does not receive the scan signal g(N−1). The voltage level of the node Q is maintained at the voltage level of the voltage VGH through the capacitor C2, such that the switches T3, T4 are turned off. Moreover, the switch T6 is turned off since the switch T6 does not receive the scan signal g(N−1). The capacitor C3 makes the voltage level on the node W change (e.g., pull up) to a voltage VGH_BT. At this time, the switch T6 is turned on briefly according to a voltage difference between the scan signal g(N−1) having the high voltage level and the voltage VGH_BT on the node W, so as to provide the voltage VGH to the node W to change (e.g., pull down) the voltage level on the node W. After the voltage on the node W is changed to the voltage VGH, the switch T6 is turned off. At this time, the switch T7 is turned off according to the voltage VGH on the node W. The switch T8 is turned off according to the clock signal B having the high voltage level.

Figure 5A:
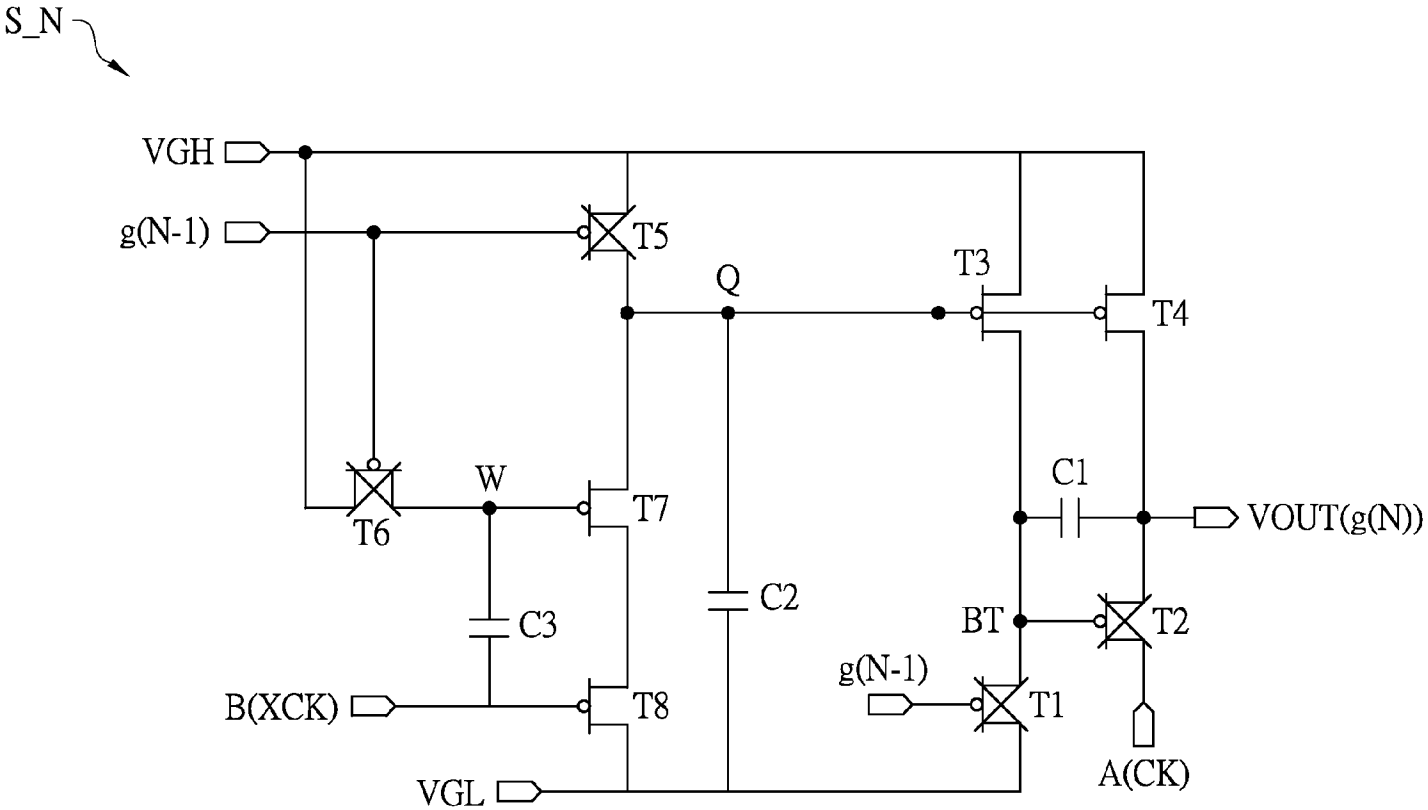
FIG. 5*a* is a diagram illustrating still another state of the shift register in FIG. 2.
Figure 5B:
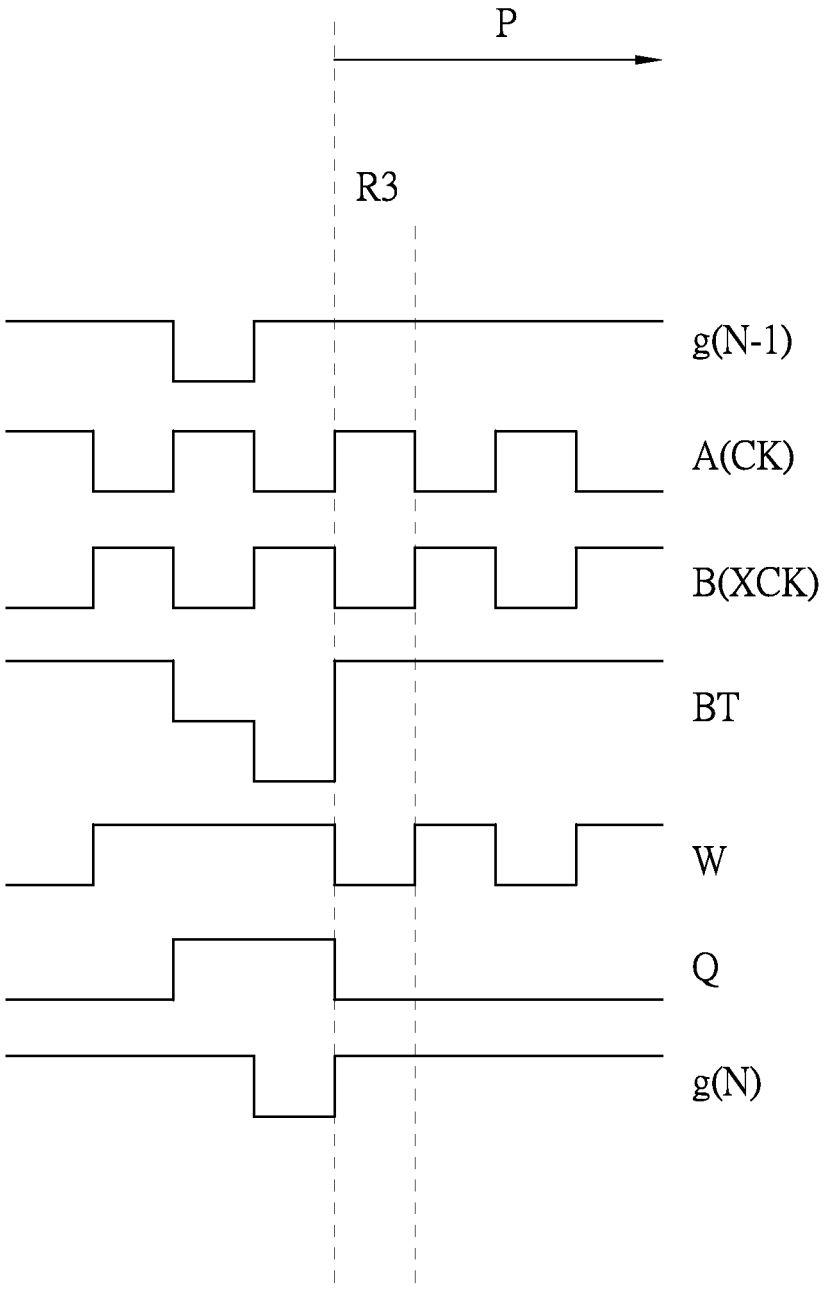
FIG. 5*b* is a time chart of signals of the shift register in FIG. 5*a;*

Subsequently, reference will now be made to FIGS. 5*a* and 5*b*. FIG. 5*a* is a diagram illustrating still another state of the shift register S_N in FIG. 2. FIG. 5*b* is a time chart of signals of the shift register S_N in FIG. 5*a*. In the duration R3, the switches T1, T5, T6 are turned off since all the switches T1, T5, T6 do not receive the scan signal g(N−1). Through the capacitor C3, the voltage on the node W is changed in a manner corresponding to the clock signal B. The switches T7, T8 are turned on according to the clock signal B with a low voltage level, so as to conduct and provide the voltage VGL to the node Q. At this time, the switch T3 is turned on according to the voltage VGL on the node Q, so as to conduct and provide the voltage VGH to the node BT. The switch T2 is turned off according to the voltage VGH on the node BT. In addition, the switch T4 is turned on according to the voltage VGL on the node Q, so as to conduct and provide the voltage VGH to the output end VOUT to stop the scan signal g(N) (e.g., to make the scan signal g(N) have a high voltage level).

Figure 6A:
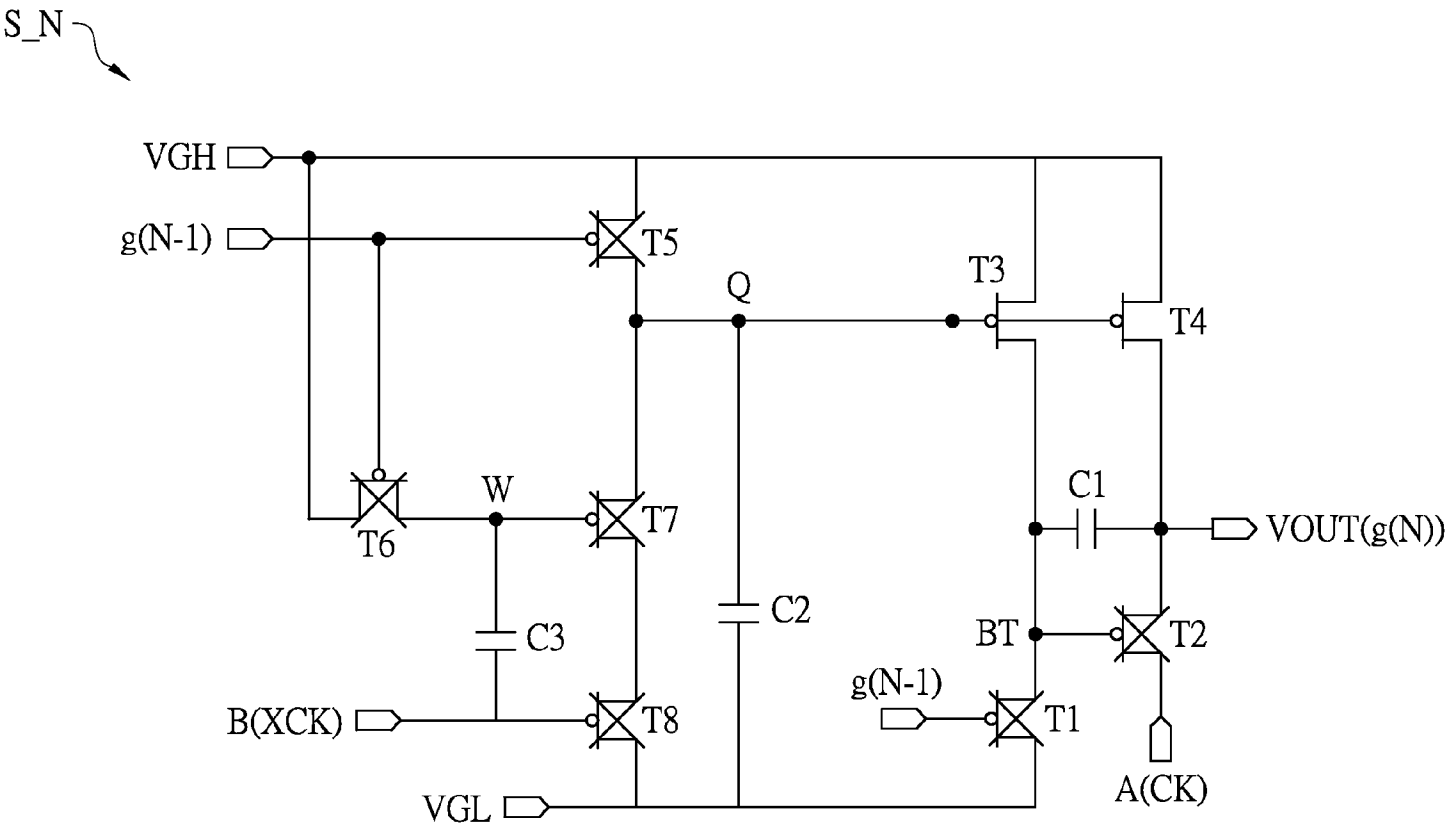
FIG. 6*a* is a diagram illustrating still another state of the shift register in FIG. 2.
Figure 6B:
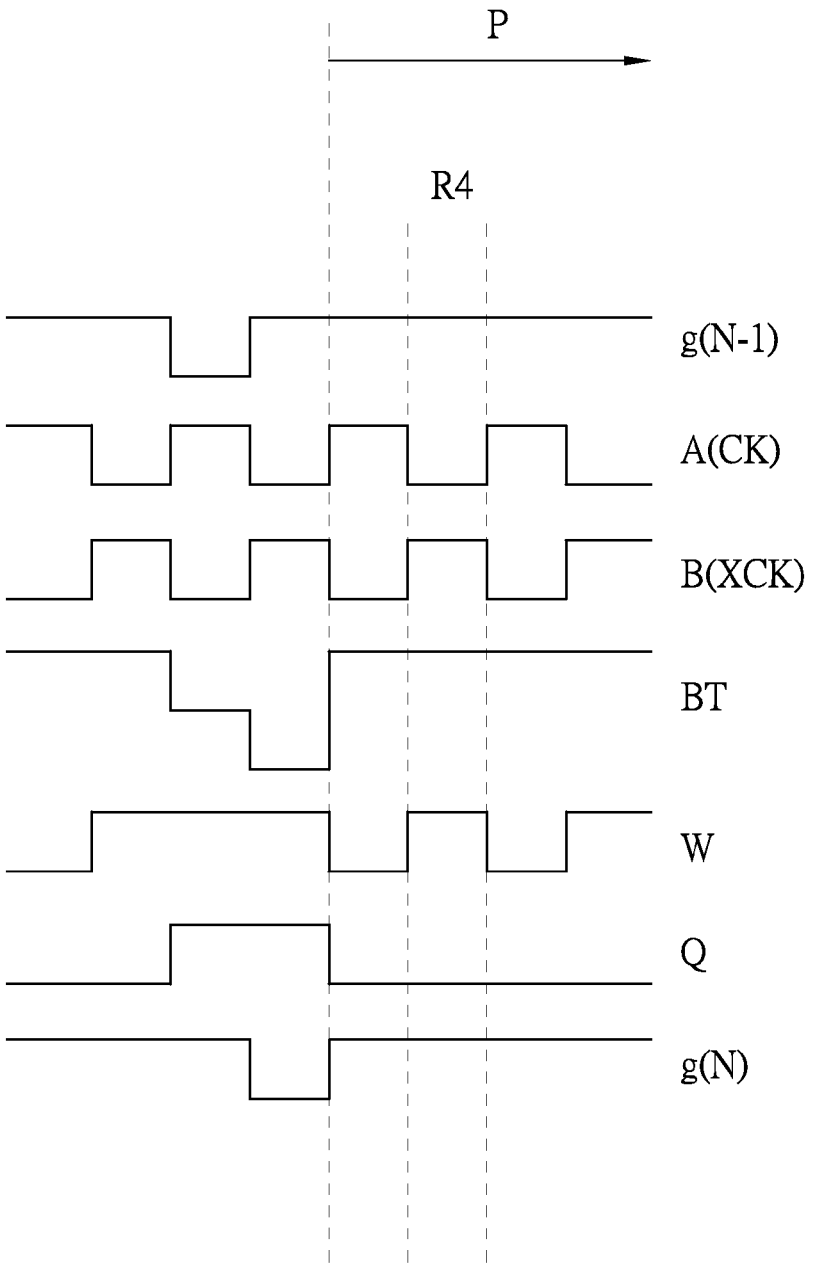
FIG. 6*b* is a time chart of signals of the shift register in FIG. 6*a;*

Subsequently, reference will now be made to FIGS. 6*a* and 6*b*. FIG. 6*a* is a diagram illustrating still another state of the shift register S_N in FIG. 2. FIG. 6*b* is a time chart of signals of the shift register S_N in FIG. 6*a*. In duration R4, the switches T1, T5, T6 are still turned off since all the switches T1, T5, T6 do not receive the scan signal g(N−1). The switches T7, T8 are turned off according to the clock signal B with a high voltage level. The switches T3 and T4 are still turned on according to the voltage VGL on the node Q, so as to respectively conduct the voltage VGH to the node BT and to the output end VOUT. The switch T2 is still turned off according to the voltage VGH on the node BT.

Subsequently, the shift register S_N repeatedly and alternatingly performs the operation in duration R3 and duration R4, so as to provide the voltage VGL to the node Q in each cycle period of the clock signal B. That is, in the duration P, the switches T1, T2, T5, T6 are turned off, the switches T3, T4 are turned on, and the switches T7, T8 are turned on and off simultaneously according to the clock signal B, so as to conduct and provide the voltage VGL to the node Q in every two line times.

With such an operation, through the switches T7, T8, the voltage VGL can be provided to the node Q in each cycle period of the clock signal B to stabilize the voltage level on the node Q. Hence, the voltage shift of the node Q, which may cause the switches T3, T4 be turned off incorrectly, can be avoided, and incorrect output of the scan signal g(N) from the shift register S_N can also be prevented.

It should be noted that although the shift register S_N is implemented by p-type transistors in the above embodiment, in practice, it can also be implemented by n-type transistors. In the following paragraphs, an embodiment of a shift register S_N', which is implemented by n-type transistors, is provided. However, the invention is not limited by the embodiment below.

Figure 7:
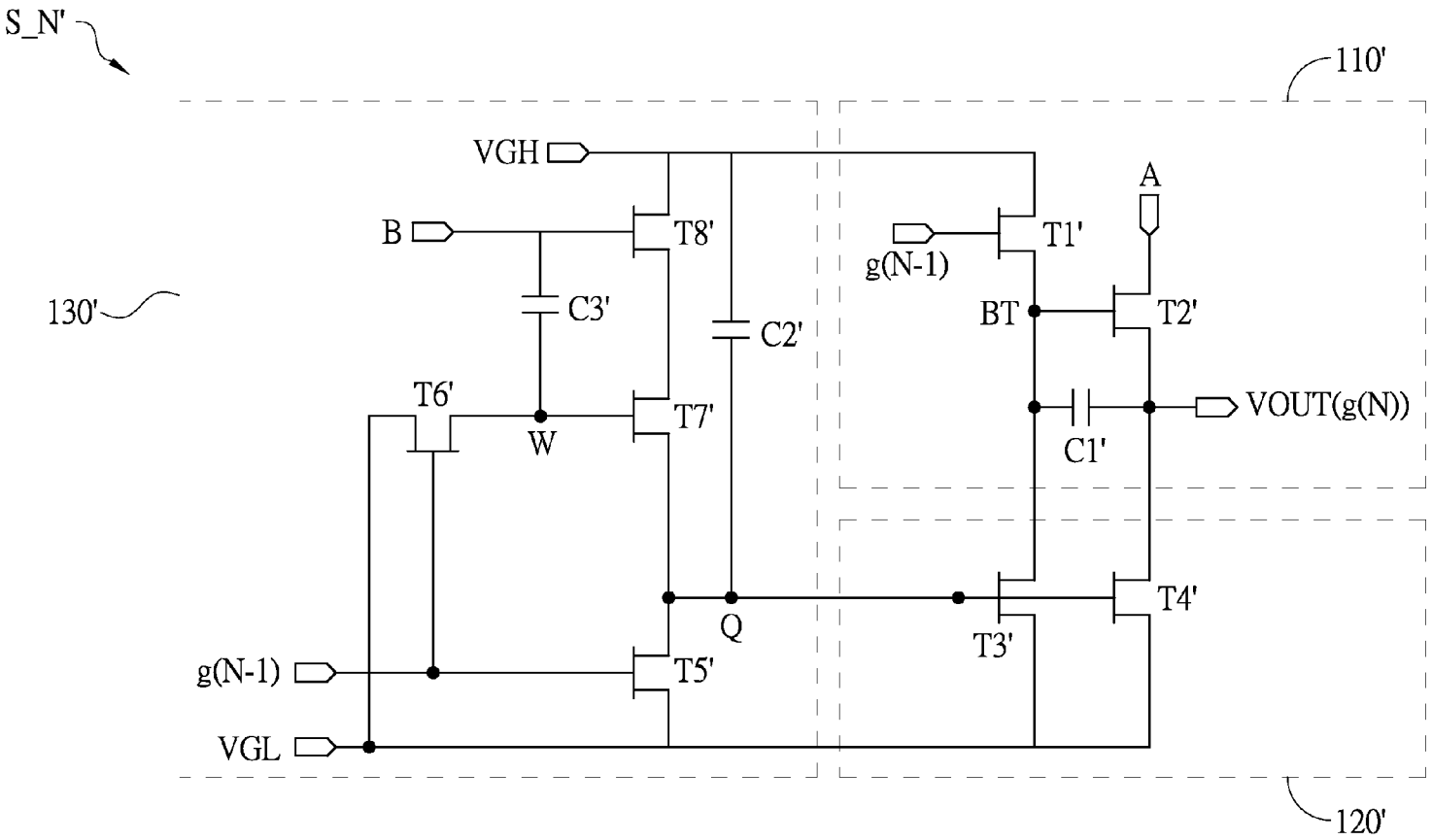
FIG. 7 is a schematic diagram of another shift register in accordance with one embodiment of the present disclosure.

FIG. 7 is a schematic diagram of the shift register S_N' in accordance with one embodiment of the present disclosure. In this embodiment, the shift register S_N' includes a driving unit 110', a control unit 120', and an operating unit 130'. The control unit 120' can be electrically connected to the driving unit 110' through a node BT and an output end VOUT. The operating unit 130' can be electrically connected to the control unit 120' through a node Q. It should be noted that, in this embodiment, the positions of the voltage VGH and the voltage VGL of the shift register S_N' are opposite to the positions of the voltage VGH and the voltage VGL of the shift register S_N in FIG. 2 (that is, in this embodiment, the positions of the voltage VGH and the voltage VGL of the shift register S_N' are interchanged). Therefore, the operations of the driving unit 110', the control unit 120', and the operating unit 130' are correspondingly changed. However, the operations of the driving unit 110', the control unit 120', and the operating unit 130' are still similar to the operations of the driving unit 110, the control unit 120, and the operating unit 130 in the previous embodiment in FIG. 2. Thus, a description of the operations that are similar will not be repeated.

The driving unit 110' can include switches T1', T2', and a capacitor C1'. The switch T1' can be electrically connected between the node BT and the node VGL, and is configured to receive the start signal (i.e., scan signal g(N−1)), and to be turned on according to the start signal, so as to conduct the voltage VGH to the node BT. One end of the switch T2' can be electrically connected to the output end VOUT, and another end of the switch T2' is configured to receive a clock signal A. The switch T2' can be configured to be turned on according to the voltage VGH on the node BT in a case that the node BT has the voltage VGH, so as to conduct the clock signal A to the output end VOUT. The capacitor C1' can be electrically connected between the node BT and the output end VOUT. In one embodiment, the capacitor C1' can be a parasitic capacitor of the switch T2.

The control unit 120' can include switches T3', T4'. The switch T3' can be electrically connected between the node BT and the voltage VGL, and configured to be turned on according to the voltage VGH on the node Q in a case that the node Q has the voltage VGH, so as to conduct the voltage VGL to the node BT. The switch T4' can be electrically connected between the output end VOUT and the voltage VGL, and configured to be turned on according to the voltage VGH on the node Q in a case that the node Q has the voltage VGH, so as to conduct the voltage VGL to the output end VOUT.

The operating unit 130' can include switches T5', T6', T7', T8' and capacitors C2', C3'. The switch T5' can be electrically connected between the voltage VGL and the node Q, and configured to receive the start signal (i.e., the scan signal g(N−1)) and to be turned on according to the start signal, so as to conduct the voltage VGL and the node Q. The switch T6' can be electrically connected between the voltage VGL and a node W, and configured to receive the start signal (i.e., the scan signal g(N−1) and to be turned on according to the start signal (i.e., the scan signal g(N−1), so as to conduct the voltage VGL to the node W. A first end of the switch T7' can be electrically connected to the node Q, a second end of the switch T7' can be electrically connected to a first end of the switch T8', and a second end of the switch T8' can be electrically connected to the voltage VGH. That is, the switches T7', T8' can be electrically connected to each other in series and be electrically connected between the node Q and the voltage VGH. The capacitor C2' can be electrically connected between the node Q and the voltage VGH. One end of the capacitor C3' can be electrically connected to the node W, and another end the capacitor C3' can be configured to receive the clock signal B. The capacitor C3' can be configured to make the voltage on the node W change in a manner corresponding to the clock signal B.

In one embodiment, the switch T1'-T8', for example, can be implemented by MOSFETs or TFTs.

Moreover, in this embodiment, since the positions of the voltage VGH and the voltage VGL of the shift register S_N' are opposite to the positions of the voltage VGH and the voltage VGL of the shift register S_N in FIG. 2, and the switch T1'-T8' are implemented by n-type transistors, the operations of the switches T1'-T8' are correspondingly changed. However, the operations of the switches T1'-T8' are still similar to the operations of the switch T1-T8 in the previous embodiment in FIG. 2. Thus, a description of the operations that are similar will not be repeated.

Figure 8:
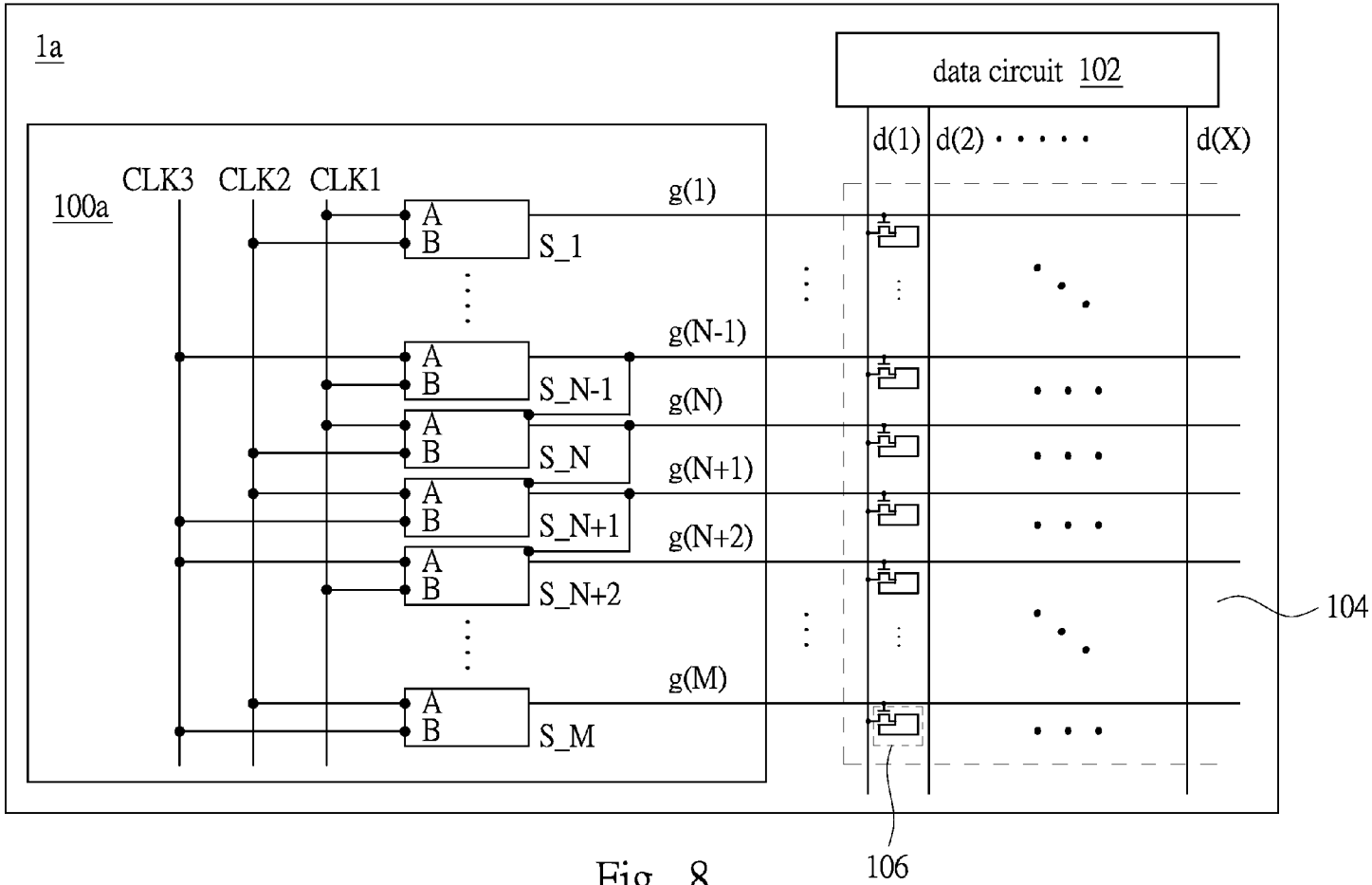
FIG. 8 is a schematic diagram of another display panel in accordance with one embodiment of the present disclosure.

FIG. 8 is a schematic diagram of another display panel 1*a* in accordance with one embodiment of the present disclosure. The display panel 1*a* can include a scan circuit 100*a*, a data circuit 102, and a plurality of pixels 106 arranged in an array (presented as a pixel array 104). The operations of the components in the display panel 1*a* are mostly similar to the operations of the same in the previous embodiment in FIG. 1. Thus, a description of the operations that are similar will not be repeated.

The scan circuit 100*a* can include a plurality of stages of shift registers S_1, . . . , S_M electrically connected in series to each other. The shift registers S_1, . . . , S_M are respectively configured to generate a plurality of scan signals g(1), . . . , g(M) according to a start signal and clock signals CK1, CK2, CK3.

In this embodiment, the scan circuit 100*a*, for example, can provide the clock signal CK1 to a first group of the shift registers S_1, S_4, . . . , S_M−1 (where a value of M−1 is a multiple of 3) to serve as clock signals A of the first group of the shift registers S_1, S_4, . . . , S_M−1, and provide the clock signal CK2 to the first group of the shift registers S_1, S_4, . . . , S_M−1 to serve as clock signals B of the first group of the shift registers S_1, S_4, . . . , S_M−1. Additionally, the scan circuit 100*a* can provide the clock signal CK2 to a second group of the shift registers S_2, S_5, . . . , S_M to serve as clock signals A of the second group of the shift registers S_2, S_5, . . . , S_M, and provide the clock signal CK3 to the second group of the shift registers S_2, S_5, . . . , S_M to serve as clock signals B of the second group of the shift registers S_2, S_5, . . . , S_M. Moreover, the scan circuit 100*a* can provide the clock signal CK3 to a third group of the shift registers S_3, S_6, . . . , S_M−2 to serve as clock signals A of the third group of the shift registers S_3, S_6, . . . , S_M−2, and provide the clock signal CK1 to the third group of the shift registers S_3, S_6, . . . , S_M−2 to serve as clock signals B of the third group of the shift registers S_3, S_6, . . . , S_M−2.

The first group of the shift registers S_1, S_4, . . . , S_M−1 can be represented as {S_i}, in which "i" is an integer divided by 3 with a remainder of 1. The second group of the shift registers S_2, S_5, . . . , S_M can be represented as {S_j}, in which "j" is an integer divided by 3 with a remainder of 2. The third group of the shift registers S_3, S_6, . . . , S_M−2 can be represented as {S_k}, in which "k" is an integer divided by 3 without remainder. The shift register S_N in FIG. 8, for example, belongs to the first group of the shift registers {S_i}, and shift register S_M in FIG. 8, for example, belongs to the second group of the shift registers {S_j}.

In this embodiment, the cycle periods of clock signals CK1, CK2, CK3 are identical, and the phases of clock signals CK1, CK2, CK3 are different from each other. Similarly, the cycle periods of clock signals A, B of each of the shift registers S_1, . . . , S_M are identical, and the phases of clock signals A, B of each of the shift registers S_1, . . . , S_M are different.

To better explain the present invention, the shift register S_N will be taken as an example to describe details of the shift registers S_1, . . . , S_M of the scan circuit 100*a*.

Figure 9A:
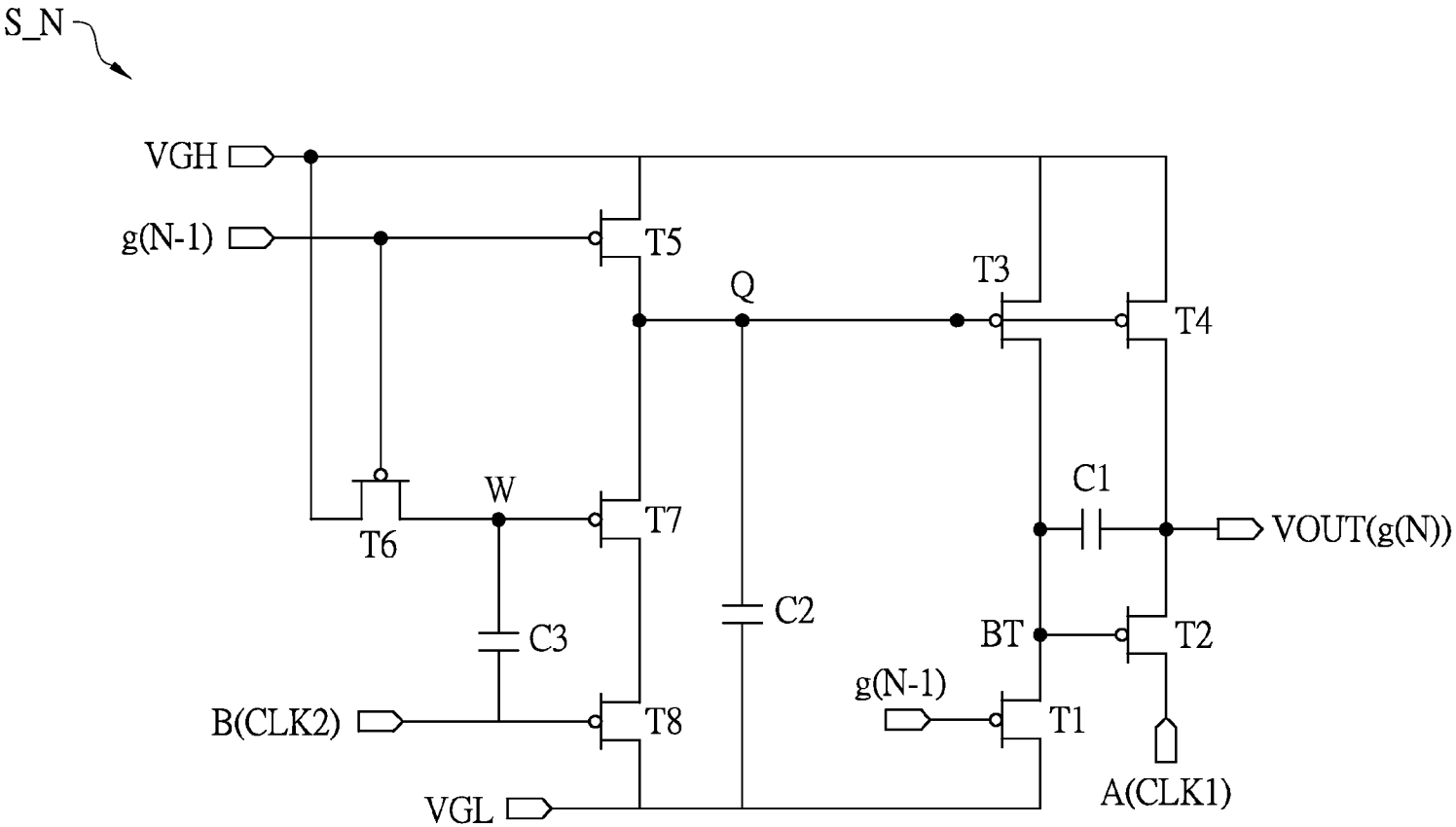
FIG. 9*a* is a schematic diagram of a shift register in FIG. 8.
Figure 9B:
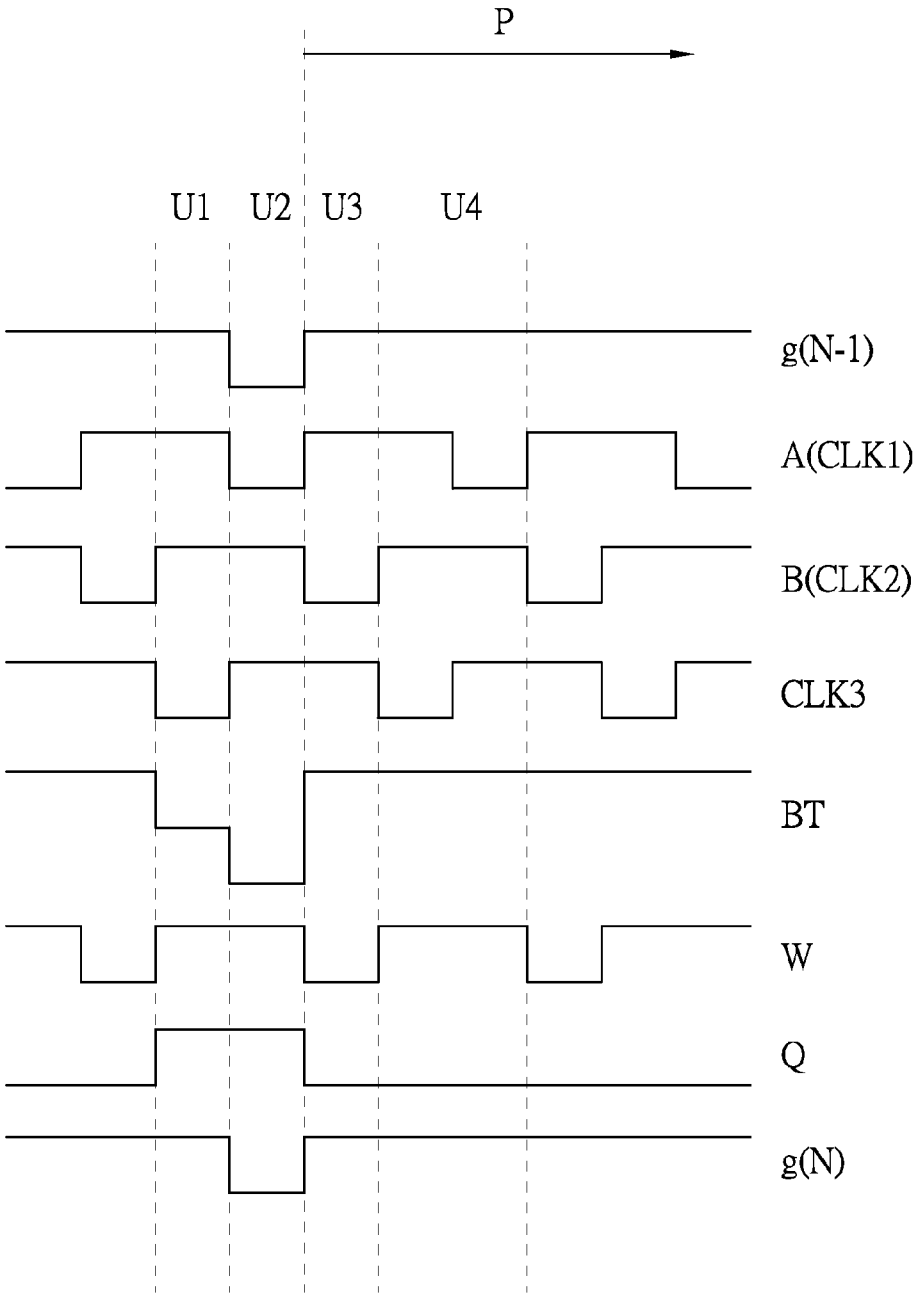
FIG. 9*b* is a time chart of signals of the shift register in FIG. 9*a;*

Reference will now be made to FIGS. 9*a* and 9*b*. FIG. 9*a* is a schematic diagram of a shift register S_N in FIG. 8. FIG. 9*b* is a time chart of signals of the shift register S_N in FIG. 9*a*. The structure of the shift register S_N in the scan circuit 100*a* can be ascertained by referring to the previous embodiment shown in FIG. 2, and a description in this regard will not be repeated herein.

In duration U1, the switch T8 is turned off according to the clock signal CLK2 having a high voltage level. The operations of the other switches (e.g., T1-T7) can be ascertained by referring to the paragraph corresponding to FIGS. 3*a*, 3*b*, and a description in this regard will not be repeated herein.

In durations U2, U3, U4, the operation of the shift register S_N of the scan circuit 100*a* can be ascertained by referring to the paragraph corresponding to FIGS. 4*a*, 4*b*, the paragraph corresponding to FIGS. 5*a*, 5*b*, and the paragraph corresponding to FIGS. 6*a*, 6*b* respectively, and a description in this regard will not be repeated herein.

Subsequently, the shift register S_N of the scan circuit 100*a* repeatedly and alternatingly performs the operation in duration U3 and duration U4, so as to provide the voltage VGL to the node Q in each cycle period of the clock signal B. That is, in the duration P, the switches T1, T2, T5, T6 are turned off, the switches T3, T4 are turned on, and the switches T7, T8 are turned on and off simultaneously corresponding to the clock signal B, so as to conduct and provide the voltage VGL to the node Q in every three line times.

Figure 10:
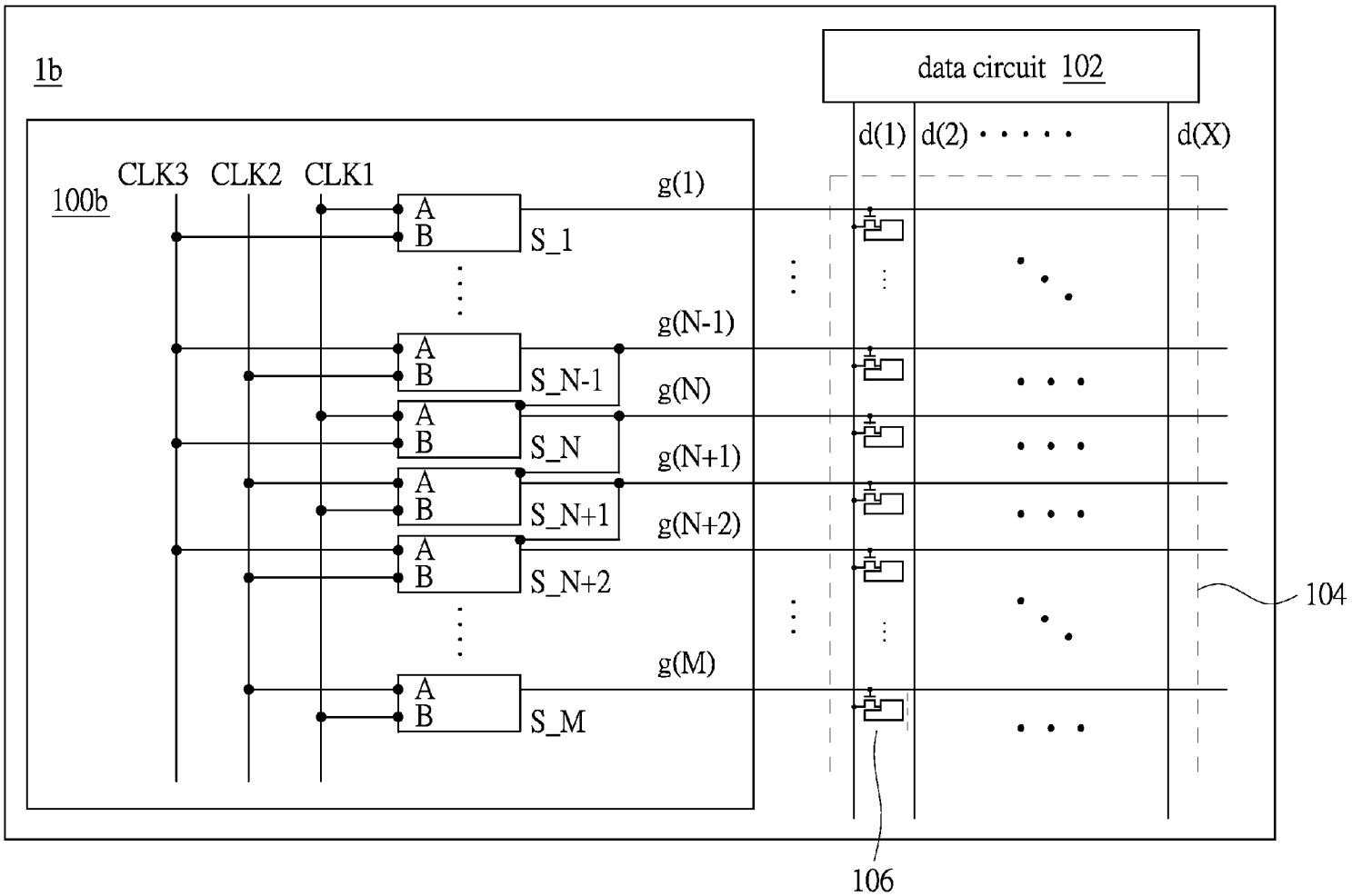
FIG. 10 is a schematic diagram of still another display panel in accordance with one embodiment of the present disclosure.

FIG. 10 is a schematic diagram of another display panel 1*b* in accordance with one embodiment of the present disclosure. The display panel 1*b* can include a scan circuit 100*b*, a data circuit 102, and a plurality of pixels 106 arranged in an array (presented as a pixel array 104). The operations of the components in the display panel 1*b* are mostly similar to the operations of the same in the previous embodiment in FIG. 1. Thus, a description of the operations that are similar will not be repeated.

The scan circuit 100*b* can include a plurality of stages of shift registers S_1, . . . , S_M electrically connected in series to each other. The shift registers S_1, . . . , S_M are respectively configured to generate a plurality of scan signals g(1), . . . , g(M) according to a start signal and clock signals CK1, CK2, CK3.

In this embodiment, the scan circuit 100*b*, for example, can provide the clock signal CK1 to a first group of the shift registers S_1, S_4, . . . , S_M−1 (where a value of M−1 is a multiple of 3) to serve as clock signals A of the first group of the shift registers S_1, S_4, . . . , S_M−1, and provide the clock signal CK3 to the first group of the shift registers S_1, S_4, . . . , S_M−1 to serve as clock signals B of the first group of the shift registers S_1, S_4, . . . , S_M−1. Additionally, the scan circuit 100*b* can provide the clock signal CK2 to a second group of the shift registers S_2, S_5, . . . , S_M to serve as clock signals A of the second group of the shift registers S_2, S_5, . . . , S_M, and provide the clock signal CK1 to the second group of the shift registers S_2, S_5, . . . , S_M to serve as clock signals B of the second group of the shift registers S_2, S_5, . . . , S_M. Moreover, the scan circuit 100*b* can provide the clock signal CK3 to a third group of the shift registers S_3, S_6, . . . , S_M−2 to serve as clock signals A of the third group of the shift registers S_3, S_6, . . . , S_M−2, and provide the clock signal CK2 to the third group of the shift registers S_3, S_6, . . . , S_M−2 to serve as clock signals B of the third group of the shift registers S_3, S_6, . . . , S_M−2.

The first group of the shift registers S_1, S_4, . . . , S_M−1 can be represented as {S_i}, in which "i" is an integer divided by 3 with a remainder of 1. The second group of the shift registers S_2, S_5, . . . , S_M can be represented as {S_j}, in which "j" is an integer divided by 3 with a remainder of 2. The third group of the shift registers S_3, S_6, . . . , S_M−2 can be represented as {S_k}, in which "k" is an integer divided by 3 without remainder. The shift register S_N in FIG. 10, for example, belongs to the first group of the shift registers {S_i}, and shift register S_M in FIG. 10, for example, belongs to the second group of the shift registers {S_j}.

In this embodiment, the cycle periods of clock signals CK1, CK2, CK3 are identical, and the phases of clock signals CK1, CK2, CK3 are different from each other. Similarly, the cycle periods of clock signals A, B of each of the shift registers S_1, . . . , S_M are identical, and the phases of clock signals A, B of each of the shift registers S_1, . . . , S_M are different.

To better explain the present invention, the shift register S_N will be taken as an example to describe details of the shift registers S_1, . . . , S_M of the scan circuit 100*b*.

Figure 11A:
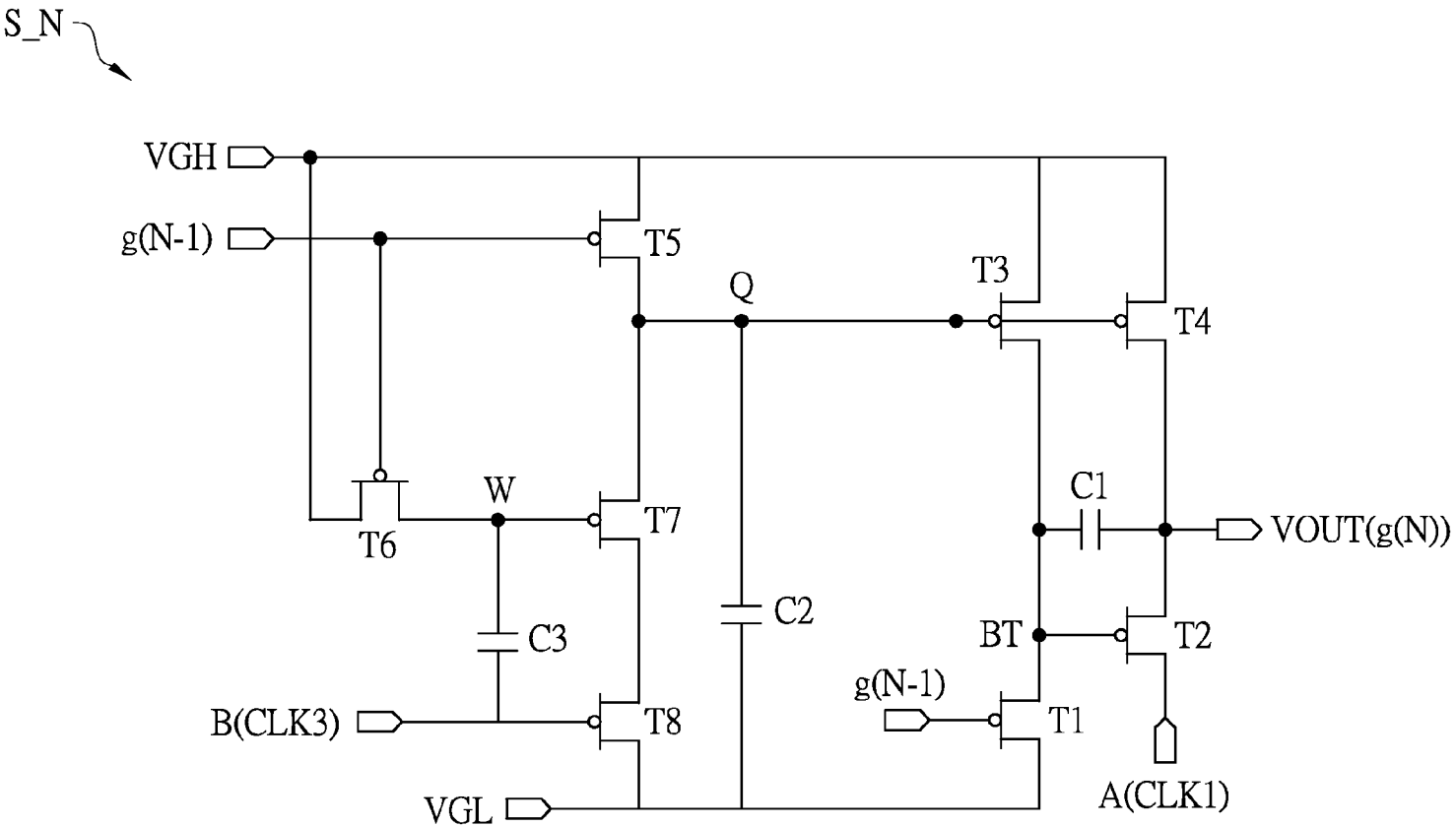
FIG. 11*a* is a schematic diagram of a shift register in FIG. 10.
Figure 11B:
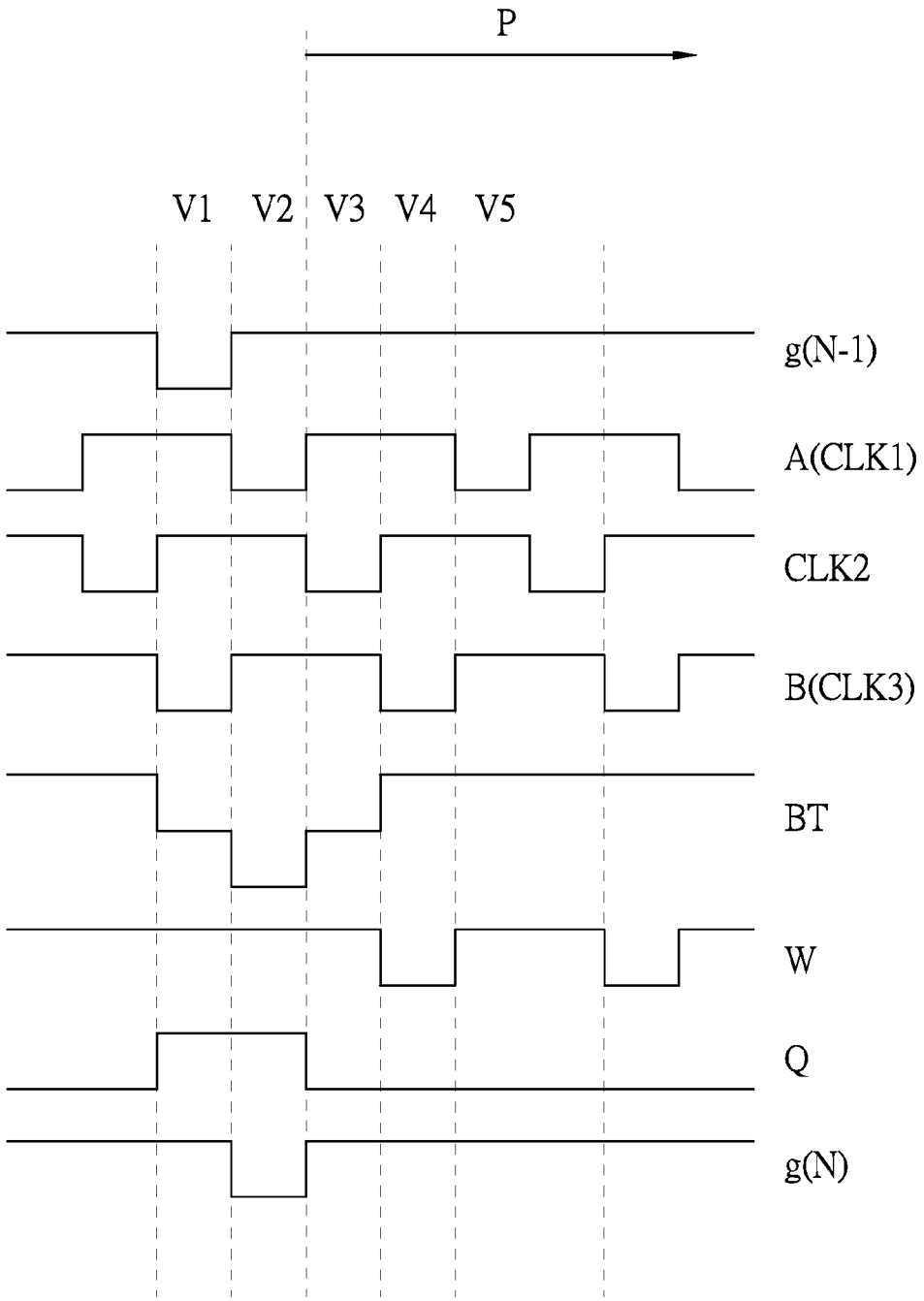
FIG. 11*b* is a time chart of signals of the shift register in FIG. 11*a*.

Reference will now be made to FIGS. 11*a* and 11*b*. FIG. 11*a* is a schematic diagram of a shift register S_N in FIG. 10. FIG. 11*b* is a time chart of signals of the shift register S_N in FIG. 11*a*. The structure of the shift register S_N in the scan circuit 100*b* can be ascertained by referring to the previous embodiment shown in FIG. 2, and a description in this regard will not be repeated herein.

In durations V1, V2, the operation of the shift register S_N of the scan circuit 100*a* can be ascertained by referring to the paragraph corresponding to FIGS. 4*a*, 4*b*, and the paragraph corresponding to FIGS. 5*a*, 5*b* respectively, and a description in this regard will not be repeated herein.

In duration V3, the switches T1, T5, T6 are turned off since all the switches T1, T5, T6 do not receive the scan signal g(N−1). Through the capacitor C3, the voltage on the node W is changed in a manner corresponding to the clock signal B. The switches T7, T8 are turned off according to the clock signal B with a high voltage level. The voltage level on the node Q is maintained at the voltage level of the voltage VGH, such that the switches T3, T4 are turned off. The capacitor C1 makes the voltage level on the node BT change (e.g., pulls up) to the voltage VGL. The switch T2 is turned on according to the voltage VGL on the node BT to provide the clock signal A having a high voltage level, so as to make the output end VOUT stop outputting the scan signal g(N) (e.g., make the scan signal g(N) have a high voltage level).

In duration V4, the switches T1, T5, T6 are turned off since all the switches T1, T5, T6 do not receive the scan signal g(N−1). Through the capacitor C3, the voltage on the node W is changed in a manner corresponding to the clock signal B. The switches T7, T8 are turned on according to the clock signal B having a low voltage level to conduct and provide the voltage VGL to the node Q. The switch T3 is turned on according to the voltage VGL on the node Q to conduct and provide the voltage VGH to the node BT. The switch T2 is turned on according to the voltage VGH on the node BT. The switch T4 is turned on according to the voltage VGL on the node Q to conduct and provide the voltage VGH to the node BT.

In duration V5, the operation of the shift register S_N of the scan circuit 100*a* can be ascertained by the paragraph corresponding to FIGS. 6*a*, 6*b*, and a description in this regard will not be repeated herein.

Subsequently, the shift register S_N of the scan circuit 100*b* repeatedly and alternatingly performs the operation in duration V4 and duration V5, so as to provide the voltage VGL to the node Q in each cycle period of the clock signal B. That is, in the duration P, the switches T1, T2, T5, T6 are turned off, the switches T3, T4 are turned on, and the switches T7, T8 are turned on and off simultaneously according to the clock signal B, so as to conduct and provide the voltage VGL to the node Q in every three line times.

Figure 12:
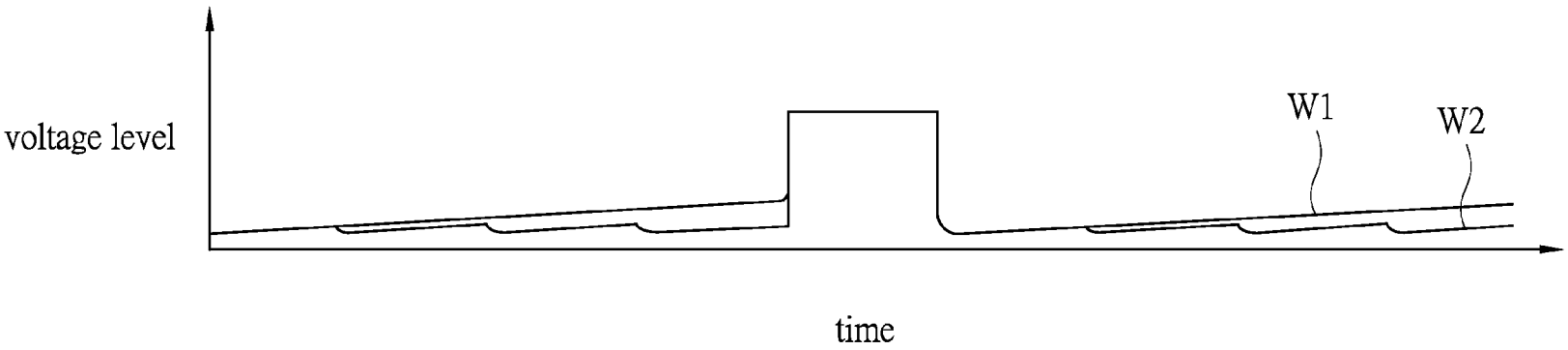
FIG. 12 is a diagram illustrating voltage measurement results of an operating node in a shift register of one embodiment of the present invention and an operating node in a shift register of a comparative embodiment.

Reference will now be made to FIG. 12, which is a diagram illustrating voltage measurement results of the node Q in a shift register S_N of one embodiment of the present invention and the node Q in a shift register of a comparative embodiment. The difference between the shift register of the comparative embodiment and the shift register S_N in one embodiment of the present invention is that, in the comparative embodiment, the voltage VGL is not provided to the node Q in each cycle period of the clock signal B. As shown in FIG. 12, line W1 illustrates the voltage level on the node Q in the shift register of a comparative embodiment, and line W2 illustrates the voltage level on the node Q in the shift register S_N in one embodiment of the present invention. Compared to line W1, the voltage level shown as line W2 is stably maintained at a low voltage level, so as to prevent the shift register S_N from operating incorrectly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A scan circuit comprising a plurality of shift registers electrically connected in series to each other, each of the shift registers comprising:

a driving unit configured to receive a start signal and a driving clock signal, and provide a scan signal to an output end according to the start signal and the driving clock signal;

a control unit electrically connected to the driving unit through a driving node, wherein the control unit is configured to provide a second voltage to the output end according to a first voltage on a control node, and to provide the second voltage to the driving node according to the first voltage on the control node; and an operating unit electrically connected to the control unit through the control node, wherein the operating unit is configured to operatively provide the first voltage to the control node according to an operating clock signal in each cycle period of the operating clock signal after the scan signal is outputted;

wherein the operating unit comprises a first operating switch and a second operating switch, and in one state, both of the first operating switch and the second operating switch are switched on according to the operating clock signal to conduct the first voltage to the control node.

2. The scan circuit as claimed in claim 1, wherein the driving unit comprises:

a first driving switch configured to be turned on according to the start signal, so as to conduct the first voltage to the driving node; and a second driving switch configured to be turned on according to the first voltage on the driving node, so as to conduct the driving clock signal to the output end.

3. The scan circuit as claimed in claim 2, wherein the driving unit further comprises:

a driving capacitor configured to make a voltage level on the driving node change to a third voltage, so as to make the second driving switch turn on according to the third voltage on the driving node.

4. The scan circuit as claimed in claim 1, wherein the driving unit comprises:

a first driving switch configured to be turned on according to the start signal, so as to conduct the first voltage to the driving node; and a second driving switch configured to be turned on according to the first voltage on the driving node, so as to conduct the driving clock signal to the output end.

5. The scan circuit as claimed in claim 4, wherein the driving unit further comprises:

a driving capacitor configured to make a voltage level on the driving node change to a third voltage, so as to make the second driving switch turn on according to the third voltage on the driving node.

6. The scan circuit as claimed in claim 1, wherein the operating unit further comprises:

a third operating switch configured to be turned on according to the start signal to conduct the second voltage to an operating node, wherein the first operating switch is further configured to operatively be turned off according to the second voltage on the operating node, so as to operatively avoid conducting the first voltage to the control node.

7. The scan circuit as claimed in claim 6, wherein the driving unit comprises:

a first driving switch configured to be turned on according to the start signal, so as to conduct the first voltage to the driving node; and a second driving switch configured to be turned on according to the first voltage on the driving node, so as to conduct the driving clock signal to the output end.

8. The scan circuit as claimed in claim 7, wherein the driving unit further comprises:

a driving capacitor configured to make a voltage level on the driving node change to a third voltage, so as to make the second driving switch turn on according to the third voltage on the driving node.

9. The scan circuit as claimed in claim 6, wherein the operating unit further comprises:

a fourth operating switch configured to be turned on according to the start signal to conduct the second voltage to the control node, so as to operatively avoid the control unit to provide the second voltage to the output end.

10. The scan circuit as claimed in claim 9, wherein the driving unit comprises:

a first driving switch configured to be turned on according to the start signal, so as to conduct the first voltage to the driving node; and a second driving switch configured to be turned on according to the first voltage on the driving node, so as to conduct the driving clock signal to the output end.

11. The scan circuit as claimed in claim 9, wherein in a stable duration, the third operating switch and the fourth operating switch are turned off, and the first operating switch and the second operating switch are turned on and turned off simultaneously, so as to operatively conduct the first voltage to the control node.

12. The scan circuit as claimed in claim 1, wherein the control unit comprises:

a first control switch configured to be turned on according to the first voltage on the control node, so as to conduct the second voltage to the driving node; and a second control switch configured to be turned on according to the first voltage on the control node, so as to conduct the second voltage to the output end.

13. The scan circuit as claimed in claim 1, wherein in a start duration, the driving unit provides the first voltage to the driving node according to the start signal, the driving unit provides a driving clock signal to the output end according to the first voltage on the driving, and the operating unit provides the second voltage to the control node according to the start signal.

14. The scan circuit as claimed in claim 1, wherein in an output duration, the driving unit changes a voltage level on the driving node to a third voltage, and provides the driving clock signal to the output end to serve as the scan signal.

15. The scan circuit as claimed in claim 1, wherein each of the driving clock signal and the operating clock signal has a cycle period and a phase, the cycle period of the driving clock signal is identical to the cycle period of the operating clock signal, and the phase of the driving clock signal is different from the phase of the operating clock signal.

16. A display panel comprising a scan circuit, wherein the scan circuit comprises a plurality of shift registers, and the shift registers are electrically connected in series to each other, each of the shift registers comprising:

a first driving switch electrically connected between a driving node and a first voltage and configured to operatively be turned on according to a start signal;

a second driving switch electrically connected to an output end, wherein the second driving switch is configured to receive a driving clock signal and to operatively be turned on according to the first voltage on the driving node;

a first capacitor electrically connected between the driving node and the output end;

a first control switch electrically connected between the driving node and a second voltage and configured to operatively be turned on according to the first voltage on a control node;

a second control switch electrically connected between the output end and the second voltage and configured to operatively be turned on according to the first voltage on the control node;

a second capacitor electrically connected between the control node and the first voltage;

a first operating switch;

a second operating switch, wherein the first operating switch and the second operating switch are electrically connected to each other in series and are electrically connected between the control node and the first voltage;

a third operating switch electrically connected between the second voltage and the operating node and configured to operatively be turned on according to the start signal;

a fourth operating switch electrically connected between the second voltage and the control node and configured to operatively be turned on according to the start signal; and a third capacitor electrically connected to an operating node and configured to receive an operating clock signal;

wherein the first operating switch and the second operating switch are configured to operatively be turned on according to the operating clock signal, so as to provide the first voltage to the control node in at least every two line times.

17. The display panel as claimed in claim 16, wherein in a start duration, the first driving switch is turned on according to the start signal to conduct the first voltage to the driving node, the second driving switch is turned on according to the first voltage on the driving node to conduct the driving clock signal to the output end, the fourth operating switch is turned on according to the start signal to conduct the second voltage to the control node, and the first control switch and the second control switch are turned off according to the second voltage on the control node.

18. The display panel as claimed in claim 16, wherein in an output duration, the first driving switch is turned off, the first capacitor makes a voltage level on the driving node change to a third voltage, and the second driving switch is turned on according to the third voltage level on the driving node to provide to driving clock signal to the output end.

19. The display panel as claimed in claim 16, wherein in a stable duration, the third operating switch and the fourth operating switch are turned off, the first operating switch and the second operating switch are turned on simultaneously according to the control clock signal to operatively conduct the first voltage to the control node, and the first control switch and the second control switch are turned on according to the first voltage on the control node, so as to conduct the second voltage and the driving node, and conduct the second voltage to the output end.

* * * * *